US006368004B2

(12) United States Patent
Yoshida et al.

(10) Patent No.: US 6,368,004 B2
(45) **Date of Patent: *Apr. 9, 2002**

(54) PEN POINT FOR MARKING PEN

(75) Inventors: Masahiro Yoshida, Toride; Tomohiro Watanabe, Tokyo, both of (JP)

(73) Assignee: Tombow Pencil Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/019,524

(22) Filed: Feb. 5, 1998

(30) Foreign Application Priority Data

Feb. 6, 1997 (JP) ..... 9-036945

(51) Int. Cl.[7] ..... B43K 5/00; B43K 8/08; B43M 11/06

(52) U.S. Cl. ..... 401/199; 401/198; 401/193

(58) Field of Search ..... 401/199, 193, 401/196, 198, 207, 14, 15, 48, 194, 267; 33/32.1, 32.3, 34, 35, 37, 41.1, 41.3, 41.4, 41.6, 44, 484

(56) References Cited

U.S. PATENT DOCUMENTS

| | | | | |
|---|---|---|---|---|
| 3,639,070 A | | 2/1972 | Davidson | 401/199 |
| 3,864,183 A | * | 2/1975 | Hori | 401/198 |
| 4,453,849 A | * | 6/1984 | Fernandez | 401/198 |
| 5,358,349 A | * | 10/1994 | Burroughs et al. | 401/199 |
| 5,827,911 A | * | 10/1998 | Hayashi et al. | 524/89 |
| 5,882,667 A | * | 3/1999 | Jones | 424/405 |

FOREIGN PATENT DOCUMENTS

| | | | | |
|---|---|---|---|---|
| DE | 2355188 | * | 11/1974 | 401/199 |
| DE | 33 36 664 A | | 4/1984 | |
| FR | 1 491 935 A | | 11/1967 | |
| JP | 39889-1970 | | 12/1970 | |
| JP | 93580-1980 | | 6/1980 | |
| JP | 164346-1981 | | 12/1981 | |
| JP | 164783-1983 | | 11/1983 | |
| JP | 162281-1984 | | 10/1984 | |
| JP | 1622181-1984 | | 10/1984 | |
| JP | 79588-1994 | | 11/1994 | |
| JP | 2679956-1997 | | 11/1997 | |
| SU | 1227510 | * | 4/1986 | 401/193 |

OTHER PUBLICATIONS

Patent Abstracts of Japan, Feb. 2, 1990, vol. 014, No. 058 (M–0930).

(List continued on next page.)

*Primary Examiner*—David J. Walczak
*Assistant Examiner*—Tuan Nguyen
(74) *Attorney, Agent, or Firm*—Butler, Snow, O'Mara, Stevens, & Cannada, PLLC

(57) ABSTRACT

A pen point for a marking pen having a pen tip which includes a base portion formed by bundling polyester-type synthetic fibers having a fiber diameter of denier between about 1 and about 10, dipping the bundle in a synthetic resin adhesive and drying and solidifying the bundle. The resulting bundle is molded into a knife cut shape and integrally coated, together with the base portion, with a coating member formed of a thermoplastic synthetic resin, the thickness of said coating member being between about 0.01 and about 2.00 mm. In the present invention, the tip of the pen point for the marking pen is coated with a coating member formed of a thermoplastic synthetic resin such as polyethylene, polypropylene, polyacetal or vinyl chloride, whereby the side surfaces in which the ink in the pen point is soaked are not exposed. Consequently, even when a line is drawn using a ruler, the contact surface between the ruler and the pen point is not stained, making it possible to avoid the inconvenience of removing ink whenever it adheres to the ruler, and to prevent the tip of the pen point from being stained.

8 Claims, 6 Drawing Sheets

OTHER PUBLICATIONS

Patent Abstracts of Japan, Apr. 6, 1982, vol. 006, No. 051 (P–108).
"'83 Catalog" of Tombow Pencil Co., Ltd., Dec., 1982, front and rear cover pages and pp. 50–59.
"K–Coat Leaflet" of Tombow Pencil Co., Ltd., Sep., 1996, two pages.
"Business Gift Catalog" of Tombow Pencil Co., Ltd., Dec., 1996, front cover page and three additional pages.
"1997 Tombow Catalog " of Tombow Pencil Co., Ltd., Dec., 1996, front and back cover pages and one additional page.

Akinori Kamel, co–pending and commonly assigned U.S. Patent Application S/N 29/073,611, attorney docket No. 785914–015, entitled "Marking Pen Nib, " filed Jul. 11, 1997, in its entirety.

* cited by examiner

PEN POINT FOR MARKING PEN

FIELD OF THE INVENTION

The present invention relates to a pen point or nib for a marking pen.

BACKGROUND

In a pen point for writing utensils such as marking pens and the like, typically, synthetic resin fibers or similar materials are bundled into a bar to draw out by capillary action the ink contained in the writing utensils so that the ink may be transferred to a writing surface.

Further, with the spread of writing utensils which are filled with fluorescent ink, pen points by which a thick line can be drawn have been in demand. Thus, pen points which are molded into knife cut shapes through polishing are commonly available. Consequently, a user could have selected a pen point according to the desired usage, and it has been possible for a user to smoothly draw a line with these known pen points.

However, the top and side surfaces of the pen point in known markers is usually exposed, and ink is also soaked in the side surface of the pen point. Therefore, when a line is drawn using a ruler or other guide tool, the contact surface between the ruler and the pen point is usually stained. Further, when the same operation is repeated using writing utensils with different ink colors, the side surfaces of these pen points are also stained. In order to avoid such an inconvenience, ink adhered to the ruler must be removed in every operation.

SUMMARY OF THE INVENTION

It is an object of the present invention to provide a pen point or nib for a marking pen which eliminates the adhesion of ink to a ruler when drawing a line using the ruler or other guide tool. It is a further objection of the present invention to provide a pen point which will not become stained when drawing a line with a ruler or other guide tool.

The above-mentioned objects of the present invention are achieved by the present pen point for a marking pen in which the tip of a pen point formed from polyester-type synthetic fibers or similar material is coated with a coating member formed of a thermoplastic synthetic resin such as polyethylene, polypropylene, polyacetal or polyvinyl chloride. Preferably, the coating material has a thickness of from between about 0.01 and about 2.00 mm. Antimicrobial properties may be imparted to the coating member, and the coating member may be rendered transparent or colored. In a preferred embodiment, the tip of the pen point projects slightly beyond the edge of the coating member.

DETAILED DESCRIPTION

Figure 1:
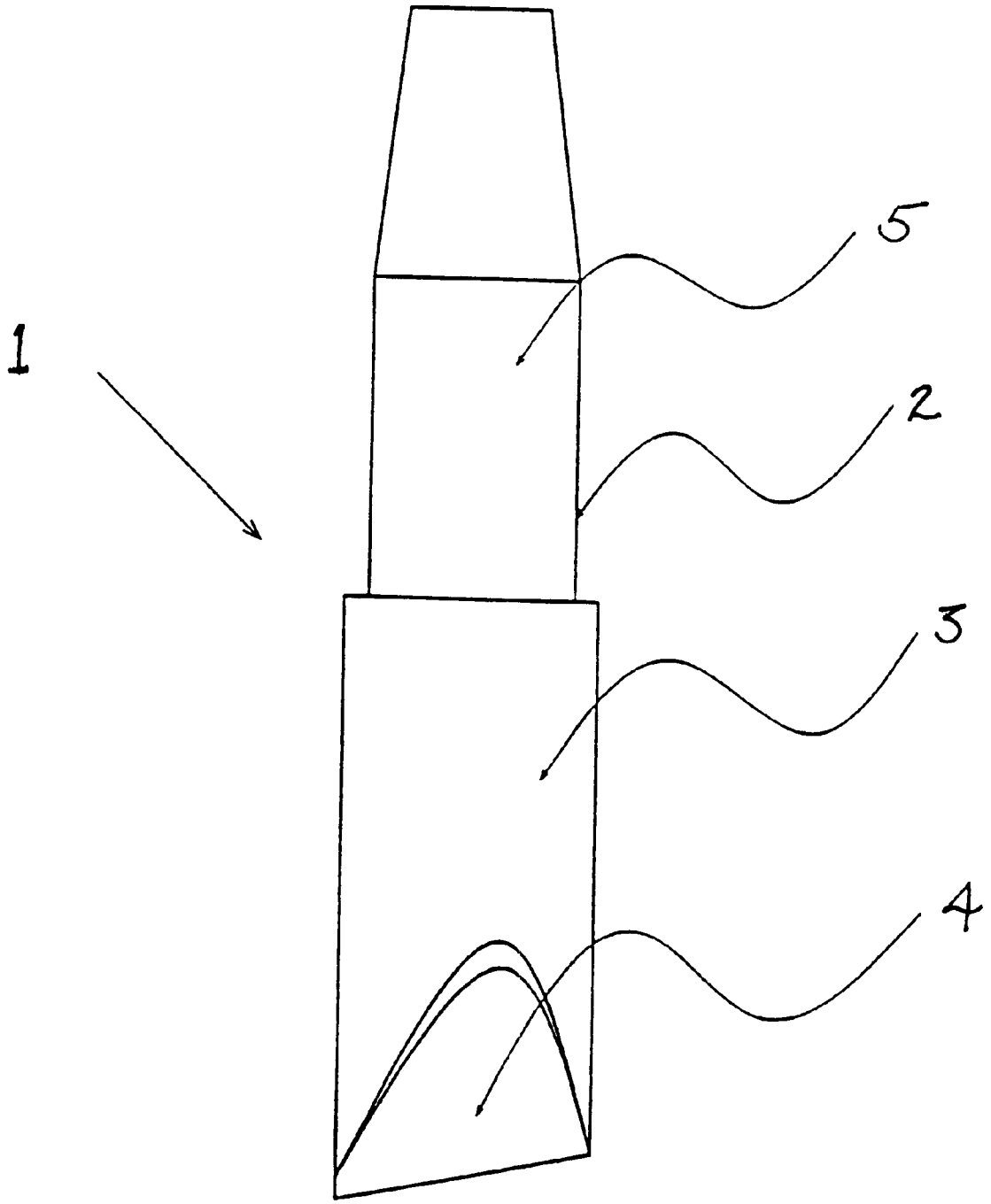
FIG. 1 is a perspective view showing a pen point for a marking pen which embodies features of the present invention.

As illustrated in FIGS. 1–6, the present invention provides a pen point 1 and for a marking pen in which a pen tip 4 is obtained by molding a base portion 2 into a knife cut shape. The base portion 2 is formed by bundling polyester-type synthetic fibers having a fiber diameter of denier between about 1 and about 10, dipping the bundle into a synthetic resin adhesive, and drying and solidifying the bundle. The resulting bundle is coated with a coating member 3 formed of a thermoplastic synthetic resin such as polyethylene, polypropylene, polyacetal or polyvinyl chloride. Preferably, the coating member 3 has a thickness of from between 0.01 and about 2.00 mm. The coating member 3 prevents the adhesion of ink to a ruler 16 when drawing a line using the ruler 16.

With respect to the polyester-type synthetic fibers used in the present invention, the fiber diameter has a denier of between about 1 and about 10, and preferably a denier of between about 2 and about 5. When the fiber diameter has a denier of less than about 1, the interstices formed between the bundled fibers are too small, which restricts the flow of ink. When the fiber diameter exceeds a denier of about 10, wide interstices are formed between the fibers when the fibers are bundled, making it difficult to control the flow of ink.

The thickness of the coating member 3 formed of the thermoplastic synthetic resin, such as polyethylene, polypropylene, polyacetal or polyvinyl chloride, is between about 0.01 and about 2.00 mm, and preferably between about 0.04 and about 1.00 mm. When the thickness of the coating member formed of the synthetic resin is less than about 0.01 mm, the synthetic resin coating member may break easily when a line is drawn using a ruler. When the thickness of the synthetic resin coating member 3 exceeds about 2.00 mm, the thickness of the coating member causes the pen point 1 to be offset from the ruler 16, making it difficult to draw a line in the position desired by the user.

In the pen point 1 for the marking pen in which the base portion 2 is coated with a coating member 3 formed of synthetic resin, antimicrobial properties may be imparted to the synthetic resin with which to coat the base portion 2 to prevent the deterioration of the desirable qualities of the marking pen nib by microorganisms during use and/or during storage. Any suitable antimicrobial agent by which to impart the antimicrobial properties to the coating member 3 may be used in the marking pen of the present invention. Preferable examples of antimicrobial agents include silver-type inorganic antimicrobial agents in which silver ions are supported on various inorganic materials, such as an antimicrobial agent in which amine silver is supported between laminates of an inorganic laminar compound such as montmorillonite or the like, an antimicrobial agent in which silver ions are supported on magnesium aluminosilicate, an antimicrobial agent in which silver ions are supported on zirconium phosphate through ion exchange, an antimicrobial agent in which silver ions are supported on a sparingly soluble phosphate or condensed phosphate, and an antimicrobial agent formed by adsorbing silver ions on hydroxyapatite and then burning the resulting substance.

In the pen point 1 of the present invention, one or more marks may be provided at any appropriate position on the surface of the coating member 3 in order to assist the user in selecting a desired width for the line to be drawn.

When a user draws a line using a ruler 16 in an ordinary manner, the line is drawn in the direction of the major or minor axis of the drawing the tip 4 of the pen point 1 for the marking pen. relative to the line drawing direction. relative to the line drawing direction, there are two line widths which can be selected. When one or more marks are provided at appropriate positions on the surface of the coating member 3, the marks serve as points of reference for the user on the surface to assist in aligning the pen with the ruler 16 at the time of drawing the line. As a result, the desired width of the line to be drawn can easily be selected within the possible range. Further, in the present pen point 1 for a marking pen, the coating member 3 which is formed of synthetic resin and which integrally coats the base portion and also the tip 4 of the pen point 1 shaped into the knife cut may be transparent or have the same color as the marking pen so that the color of the marking pen can be readily determined in order to prevent the accidental use of the wrong color.

In addition, when drawing a line, it is advisable that the tip 4 of the pen point 1 in the base portion 2 be placed in alignment with the edge 15 of the coating member 3 of synthetic resin. However, if the tip of the pen point is projected slightly beyond the coating member, for example by about 2.0 mm or less, then the decrease in the hardness of the base portion 2, and especially the tip 4 of the pen point 1, which is caused by significantly extending the tip 4 of the pen point 1 is prevented, and an appropriate hardness is provided, making it possible for a user to smoothly draw a line for a long period of time.

As described above, the tip 4 of the present pen point 1 for a marking pen is coated with a coating member 3 formed of a thermoplastic synthetic resin such as polyethylene, polypropylene, polyacetal or vinyl chloride, so that the surface in which the ink in the pen point is soaked can be restricted or is not exposed. Consequently, even when a line is drawn using a ruler 16, the contact surface between the ruler 16 and the pen point 1 is not stained, making it possible to avoid the inconvenience of having to repeatedly remove ink which adheres to the ruler 16 during use.

EXAMPLE

The pen point for the marking pen of the present invention is illustrated specifically by referring to the drawings attached hereto. As shown in FIG. 1, the pen point 1 for a marking pen in the present invention includes a base portion 2 formed by bundling, for example, polyester-type synthetic fibers having a fiber diameter of a denier of between about 1 and about 10, dipping the bundle in a synthetic resin adhesive and drying and solidifying the resulting bundle. The base portion 2 is coated with a filmy coating member 3. The base portion 2 includes a pen tip 4 which is typically polished or molded into a knife cut shape, and a holder 5 which is connected to the pen tip 4. The coating member 3 may be formed of a thermoplastic synthetic resin such as polyethylene, polypropylene, polyacetal or polyvinyl chloride or similar material and preferably has a thickness of from between about 0.01 and about 2.00 mm. In a preferred embodiment, the coating member 3 is integrally coated on the outer periphery or side surfaces of the pen tip 4. When the pen tip 4 is coated with a coating member 3, the pressure exerted on the tip 4 during use will not deform the shape of the tip 4, and the coating member 3 is retained without being detached from the pen tip 4.

A silver-type inorganic antimicrobial agent may be added to the coating member 3 formed of the thermoplastic synthetic resin. The antimicrobial agent is not particularly limited, and any antimicrobial agent can be used so long as the antimicrobial agent is effective for preventing the deterioration of the quality of the pen tip 4 caused by the growth of microorganisms during use and/or during storage of the marking pen.

Figure 2:
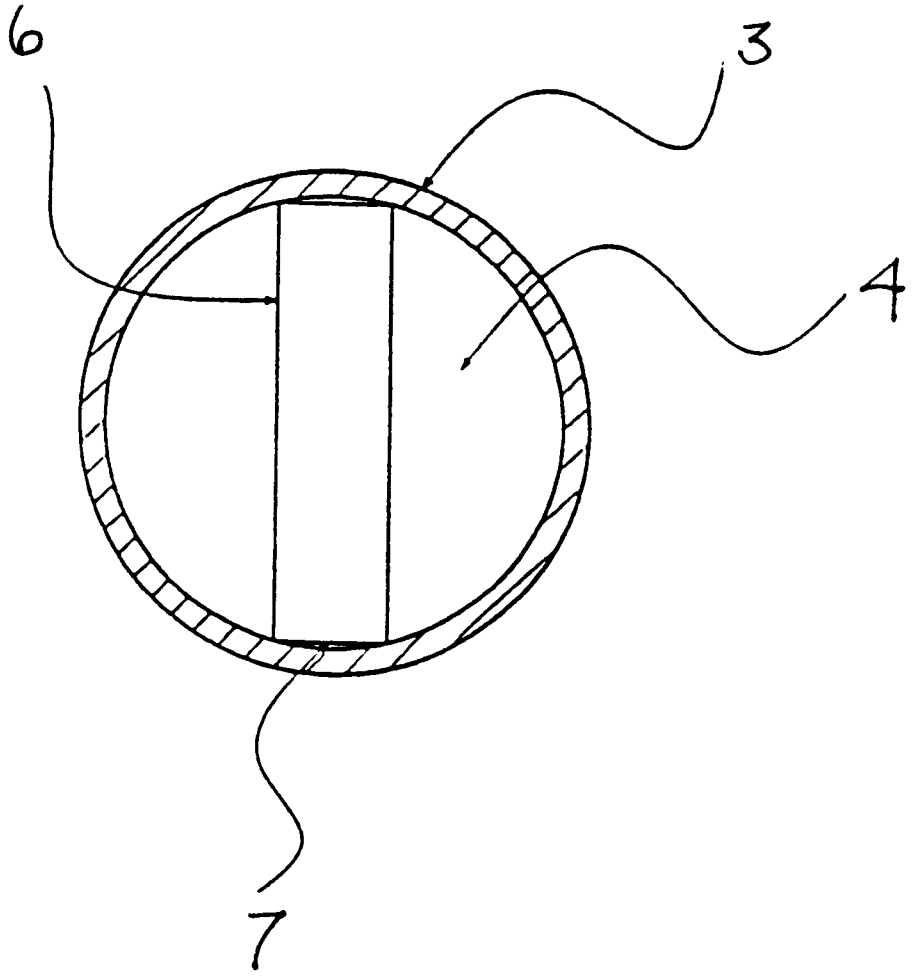
FIG. 2 is a plan view of a pen point for a marking pen which embodies features of the present invention.
Figure 3:
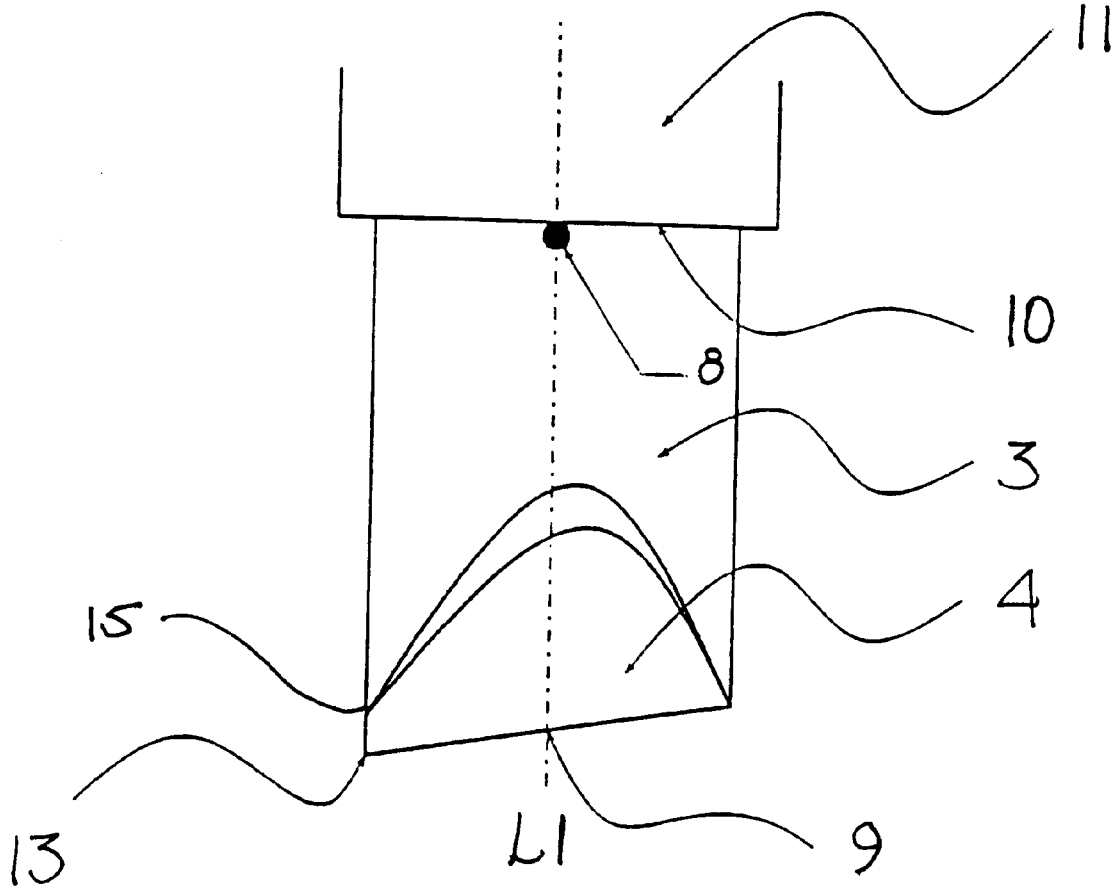
FIG. 3 is a view showing the pen point for a marking pen of FIG. 1 in which a first mark is provided on the surface of the coating member.
Figure 4:
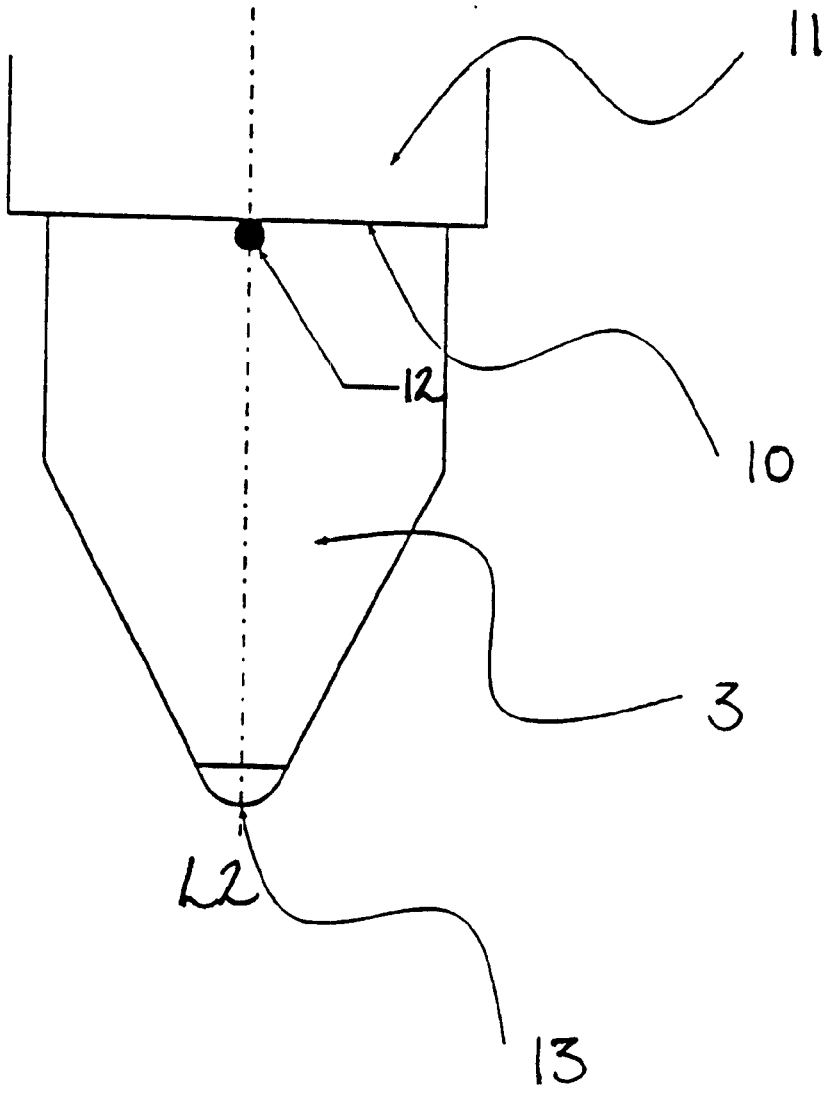
FIG. 4 is a view showing a pen point for a marking pen in which a second mark is provided on the surface of the coating member.
Figure 5:
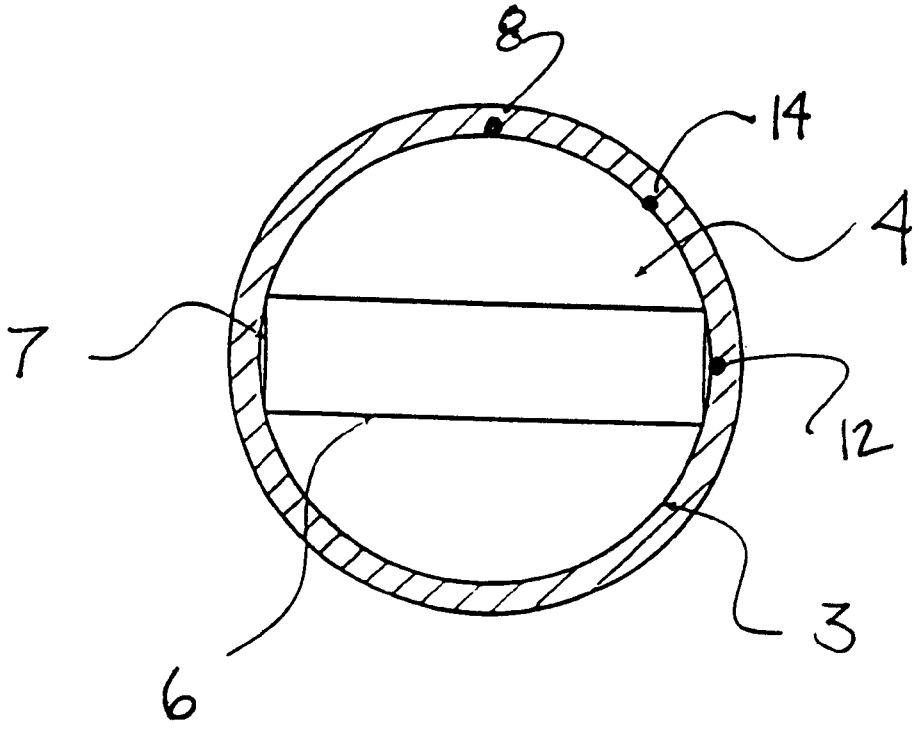
FIG. 5 is a plan view of a pen point for a marking pen in which a third mark is provided on the surface of the coating member.
Figure 6:
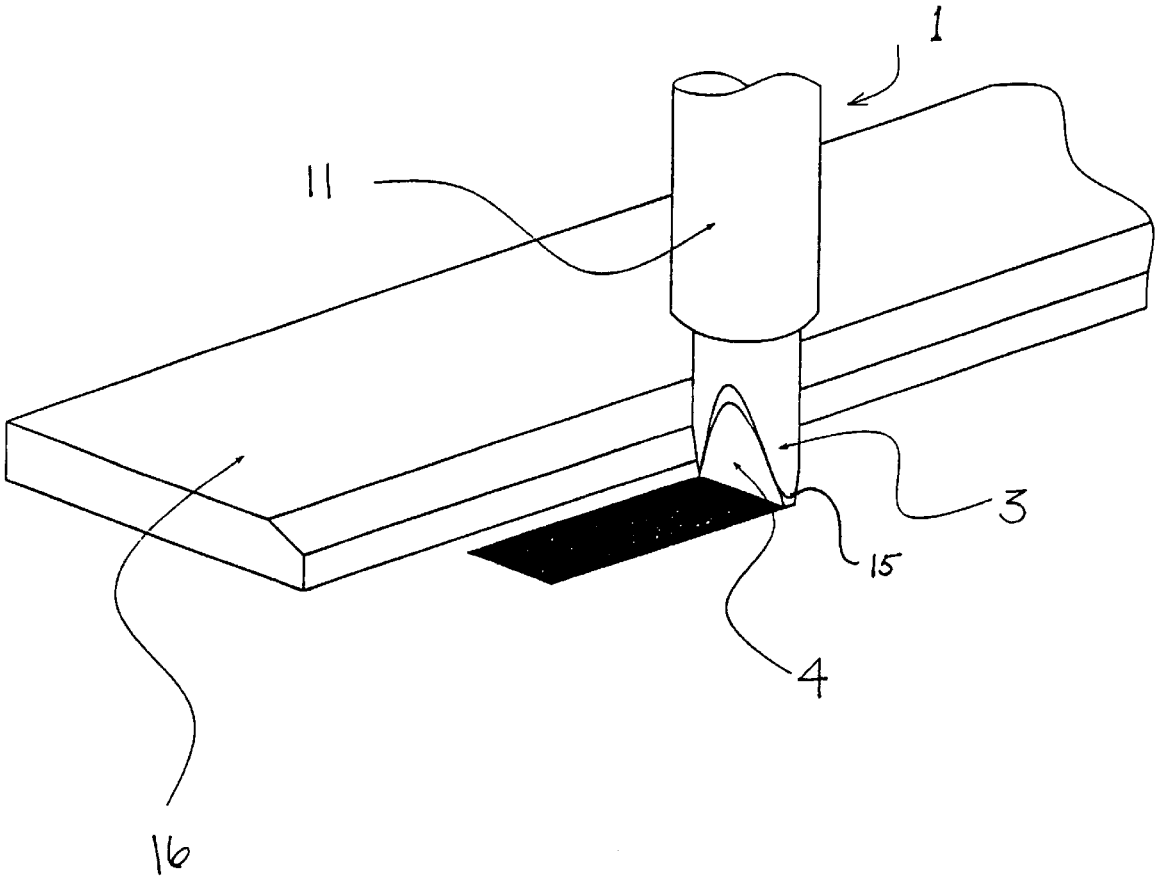
FIG. 6 is a view showing a mode of using a pen point which embodies features of the present invention.

As shown in FIG. 2, a drawable line and a pen point 1 have the relationship $m \geqq x \geqq n$ wherein m is the length of a long side 6 of the pen point 1, is the length of a short side 7 of the pen point 1, and x is the width of a drawable line. In order to easily select a desired width for the drawable line within the possible range, as shown in FIG. 3, a first mark 8 can be provided at an intersecting point between a line L1 which extends from the center 9 of a pen core drawing portion through the surface of the coating member 3, and the front end surface 10 of the pen core holding portion 11. Further, as shown in FIG. 4, a second mark 12 may be provided at an intersecting point between a line L2 which extends from the top 13 of the pen point drawing portion, through the surface of the coating member 3 and the front end surface 10 of the pen core holding portion 11. Still further, as shown in FIG. 5, a third mark 14 can be provided at the center of an arch formed between marks 8 and 12 on the surface of the coating member 3 on tip 4.

In addition, in the pen point 1 for a marking pen, the coating member 3 and the pen tip 4 may be colorless and transparent, or may have the same color as the marking pen, whereby a user can determine the color of the marking pen easily and surely. This assists the user in preventing the use of the wrong color of the marking pen. Moreover, it is preferable that the pen tip 4 in the base portion 2 projects only slightly beyond the edge 15 of the coating member 3, such as by approximately between 0.1 mm to 2.0 mm. This prevents a decrease in the hardness of the base portion 2, especially the pen tip 4 which occurs when the pen tip 4 significantly protrudes beyond the edge 15 of the coating member 3, and provides an appropriate hardness, making it possible for a user to smoothly draw a line for a long period of time.

What is claimed is:

1. A pen point for a marking pen containing ink which comprises:

a base portion formed from synthetic fibers, said synthetic fibers having a denier of between about 1 and about 10, said base portion having a pen tip which includes a lower portion, said base portion being formed by bundling said synthetic fibers, dipping said bundled synthetic fibers in a synthetic resin adhesive, drying and solidifying said bundled synthetic fibers, and shaping said lower portion of said pen tip into a knife-cut shape; and a coating member formed of a thermoplastic synthetic resin, said coating member being integrally formed with said base portion, wherein said coating member coats said base portion and has a thickness of between about 0.01 and about 2.00 mm;

said lower portion of said pen tip being devoid of said coating member, said lower portion of said pen tip including a writing surface having first and second sides and first and second ends, said pen tip further including a pair of generally U-shaped lateral surfaces, each of said lateral surfaces extending upwardly and laterally outwardly from one of said first and second sides of said writing surface, wherein said pen tip of said base portion protrudes beyond said coating member by about 2.0 mm or less and one of said first and second ends of said writing surface is spaced farther apart from said coating member than the other of said first and second ends of said writing surface.

2. The pen point of claim 1 which further comprises an antimicrobial agent in said thermoplastic synthetic resin used to form said coating member.

3. The pen point of claim 1 wherein the thermoplastic synthetic resin for the coating member is selected from the group consisting of polyethylene, polypropylene, polyacetal and polyvinyl chloride.

4. The pen point of claim 1, wherein the coating member formed of the thermoplastic synthetic resin is transparent.

5. The pen point of claim 1 wherein the coating member formed of the thermoplastic resin is the same color as the ink in the marking pen.

6. A pen point for a marking pen containing ink which comprises:

a base portion formed from synthetic fibers, said base portion having a pen tip; and a coating member formed of a thermoplastic synthetic resin together with said base portion, said coating member being integrally formed with said base portion and said coating member having a thickness of between about 0.01 and about 2.00 mm;

wherein one or more marks are provided at predetermined positions on the surface of the coating member of said base portion for selecting a desired width of a line to be drawn.

7. A pen point for a marking pen containing ink which comprises:

a substantially cylindrical base portion formed from synthetic fibers, said synthetic fibers having a denier of between about 1 and about 10, said base portion having a pen tip which includes a lower portion, said base portion being formed by bundling said synthetic fibers, dipping said bundled synthetic fibers in a synthetic resin adhesive, drying and solidifying said bundled synthetic fibers, and shaping said lower portion of said pen tip into a knife-cut shape; and a coating member formed of a thermoplastic synthetic resin, said coating member being integrally formed with said base portion, wherein said coating member coats said base portion and has a thickness of between about 0.01 and about 2.00 mm, said thermoplastic synthetic resin for said coating member being selected from the group consisting of polyethylene, polypropylene, polyacetal and polyvinyl chloride, said coating member including an antimicrobial agent in said thermoplastic synthetic resin;

said lower portion of said pen tip being devoid of said coating member, said lower portion of said pen tip including a writing surface having first and second sides and first and second ends, said pen tip further including a pair of generally U-shaped lateral surfaces, each of said lateral surfaces extending upwardly and laterally outwardly from one of said first and second sides of said writing surface, wherein said pen tip of said base portion protrudes beyond said coating member by about 2.0 mm or less and one of said first and second ends of said writing surface is spaced farther apart from said coating member than the other of said first and second ends of said writing surface.

8. The pen point of claim 7, further including:

one or more marks provided at predetermined positions on the surface of said coating member for selecting a desired width of a line to be drawn.

* * * * *